US005160137A

United States Patent [19]

Katayama

[11] Patent Number: 5,160,137

[45] Date of Patent: Nov. 3, 1992

[54] IRON GOLF CLUB SET

[75] Inventor: Yutaka Katayama, Tokyo, Japan

[73] Assignee: Maruman Golf Kabushiki Kaisha, Tokyo, Japan

[21] Appl. No.: 857,129

[22] Filed: Mar. 25, 1992

Related U.S. Application Data

[63] Continuation of Ser. No. 598,578, Oct. 17, 1990, abandoned, which is a continuation of Ser. No. 401,686, Sep. 1, 1989, abandoned.

[30] Foreign Application Priority Data

Sep. 2, 1988 [JP] Japan ..... 63-218440

[51] Int. Cl.[5] ..... A63B 53/04

[52] U.S. Cl. ..... 273/77 A; 273/167 R; 273/167 F

[58] Field of Search ..... 273/77 A, 167 R, 167 A, 273/167 F, 167 J, 169, 173

[56] References Cited

U.S. PATENT DOCUMENTS

| | | | |
|---|---|---|---|
| 3,059,926 | 10/1962 | Johnstone | 273/167 R |
| 3,814,437 | 6/1974 | Winquist | 273/167 F |
| 4,322,083 | 3/1982 | Langi | 273/167 F |
| 4,802,672 | 2/1989 | Long | 273/77 A |
| 4,826,172 | 5/1989 | Antonious | 273/169 |
| 4,854,581 | 8/1989 | Long | 273/167 A |
| 4,915,386 | 4/1990 | Antonious | 273/167 F |

FOREIGN PATENT DOCUMENTS 59-12915 4/1984 Japan .

OTHER PUBLICATIONS

"Golf Digest" Feb. 1988, p. 51 (273-1678).
"Golf Digest" Dec. 1974, p. 2 (273-167D).

*Primary Examiner*—V. Millin
*Assistant Examiner*—Raleigh W. Chiu
*Attorney, Agent, or Firm*—Armstrong & Kubovcik

[57] ABSTRACT

An iron golf club including a head having a hitting surface for hitting a golf ball. In the iron golf club set, a ratio of a first value of the width of the hitting surface on the side of the toe to a second value of the width of the hitting surface on the side of the heel becomes larger as the length of the shaft becomes longer.

1 Claim, 2 Drawing Sheets

IRON GOLF CLUB SET

This application is a continuation of application Ser. No. 598,578 filed Oct. 17, 1990, now abandoned which in turn is a continuation of application Ser. No. 401,686 filed Sept. 1, 1989, now abandoned.

BACKGROUND OF THE INVENTION

1. Field of the Invention

The present invention relates to an iron golf club set.

2. Description of the Related Art

An iron golf club comprises a shaft and a head with a hitting surface for hitting a golf ball, as is well known, and a sole is provided at the bottom of the head. A plurality of iron golf clubs used as an iron golf club set have relative and well balanced configurations and dimensions, and usually, long iron golf clubs, middle iron golf clubs, short iron clubs and wedges are included in the iron golf club set.

Japanese Examined Utility Model Publication No. 59-12915 discloses an iron golf club set in which a weighted portion is provided at the rear surface of the head of each of the iron golf clubs. The position of the weighted portion is varied in each iron golf club and is displaced nearer to the sole as the length of the iron golf club in the set becomes shorter, based on the fact that the loft becomes larger and the hitting point becomes lower as the length of the iron golf club in the set becomes shorter.

Usually, identical features are given to each iron golf club in the conventional iron golf club set, except for the length of the shafts and the loft. In the above recited Japanese Examined Utility Model Pulbication No. 59-12915, however, the weighted portion in the rear surface of the head in each iron golf club is displaced to thereby vary the position of the sweet spot and the area of the sweet spot is widened. Accordingly, recent proposals have been made to vary the same features in the same iron golf club set. In this connection, players generally suffer from the occurrence of hooking and slicing, in particular, slicing occurs when using a long iron golf club, and thus the players often hesitate to use the long iron golf clubs.

SUMMARY OF THE INVENTION

The object of the present invention is to provide an iron golf club set by which the player can obtain a stable swing.

According to the present invention, an iron golf club set comprises a plurality of iron golf clubs, each of the iron golf clubs including a shaft and a head attached to the shaft, the head having a hitting surface for hitting a golf ball, a rear surface on the back of the hitting surface, a sole between the hitting surface and the rear surface, and a toe and a heel, wherein a ratio of a first value of the width of the hitting surface on the side of the toe to a second value of the width of the hitting surface on the side of the heel becomes larger as the length of the shaft in the set becomes longer. Preferably, a weighted portion is provided on the rear surface of the head of each of the iron golf clubs, the weighted portion being displaced nearer to the sole as the length of the iron golf club in the set becomes shorter.

In this arrangement, the position of the center of gravity of the head of the iron golf club is displaced toward the toe, as the length of the shaft in the set becomes longer, by ensuring that a ratio of a first value of the width of the hitting surface on the side of toe to a second value of the width of the hitting surface on the side of the heel becomes larger as the length of the shaft in the set becomes longer. Therefore, it is possible to hit the golf ball at the hitting surface near the toe when using a long iron golf club, and thus the player can easily obtain a smooth swing if the player knows that a toe-hit will not cause slicing. Also, it is possible to vary the position of the sweet spot in each iron golf club, and widen the area of the sweet spot, by displacing the position of the weighted portion of the back design.

BRIEF DESCRIPTION OF THE DRAWINGS

The present invention will become more apparent from the following description of the preferred embodiment with reference to the accompanying drawing in which.

DESCRIPTION OF THE PREFERRED EMBODIMENT

Figure 1:
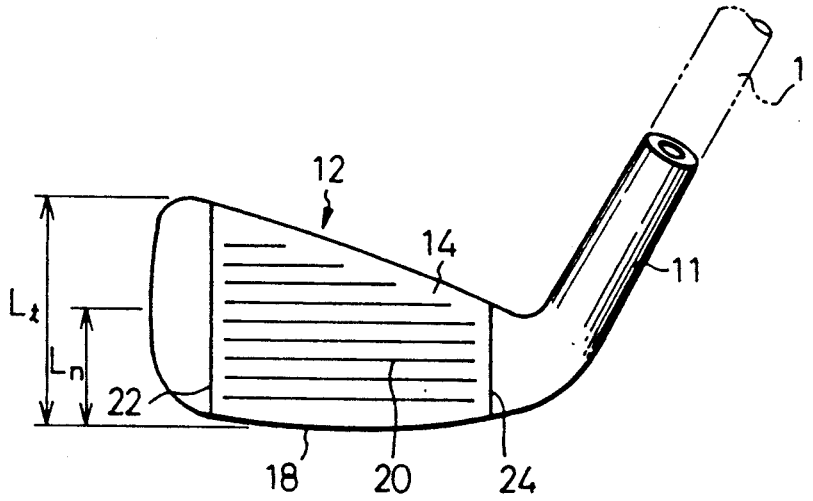
FIG. 1 is a front side view of a head of an iron golf club.
Figure 2:
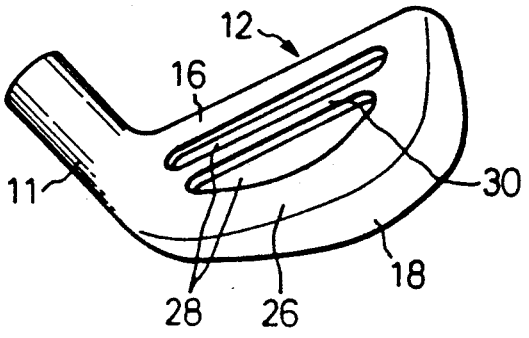
FIG. 2 is a back view of the iron golf club in FIG. 1.

Referring to FIG. 1 and 2, an iron golf club comprises a shaft 1 and a head 12. The head 12 comprises a hosel 11 connecting the head 12 to the shaft 1 in a known manner and a hitting surface 14 for hitting a golf ball, a rear surface 16, and a sole 18.

A scored area 20 is provided in the hitting surface 14. The scored area 20 is defined by a toe side scoring boundary line 22 and a heel side scoring boundary line 24. In FIG. 1, the width of the hitting surface 14 on the side of the toe is represented by $L_t$, which is measured along the toe side scoring boundary line 22, and the width of the hitting surface 14 on the side of the heel is represented by $L_n$, which is measured along the heel side scoring boundary line 24. According to the present invention, the width of the hitting surface 14 is varied in each iron golf club in the same iron golf club set, and examples of $L_t$, $L_n$, and a ratio thereof ($L_t/L_n$) in each iron golf club are exemplified in the following Table.

| | 3i | 4i | 5i | 6i | 7i | 8i | 9i | PW | AW |
|---|---|---|---|---|---|---|---|---|---|
| $L_t$ | 48.5 | 49.0 | 49.5 | 50.5 | 52.0 | 53.5 | 55.5 | 57.5 | 59.0 |
| $L_n$ | 24.5 | 25.0 | 26.0 | 27.0 | 28.0 | 29.0 | 30.5 | 32.0 | 33.0 |
| $L_t/L_n$ | 1.98 | 1.96 | 1.90 | 1.87 | 1.86 | 1.84 | 1.82 | 1.80 | 1.79 |

As clear from this Table, the width of the hitting surface 14 is such that a ratio ($L_t/L_n$) of a first value $L_t$ on the side of the toe to a second value $L_n$ on the side of the heel becomes larger as the length of the shaft in the set becomes longer.

The following Table shows typical measurement examples of iron golf clubs of the prior art.

| | 3i | 4i | 5i | 6i | 7i | 8i | 9i | PW | AW |
|---|---|---|---|---|---|---|---|---|---|
| $L_t$ | 51.0 | 51.5 | 52.0 | 53.5 | 55.0 | 57.0 | 60.0 | 62.0 | 63.0 |
| $L_n$ | 30.0 | 30.0 | 30.0 | 30.5 | 31.0 | 32.0 | 33.7 | 34.7 | 35.0 |
| $L_t/L_n$ | 1.70 | 1.72 | 1.73 | 1.75 | 1.77 | 1.78 | 1.78 | 1.79 | 1.80 |

As shown in FIG. 2, there is a back design in the rear surface 16. In the embodiment, an enclosing rim wall 26 forms a recess 28 and a horizontally extending rib-like weighted portion 30 is provided in the recess. The weighted portion 30 can be arranged so that it divides the recess 28 into two sections, as shown in FIG. 2, or the weighted portion 30 can be arranged to form an island in the recess 28. The position of this weighted portion 30 is arranged at the back of of the hitting point and displaced nearer to the sole 18 as the length of the iron golf club in the set becomes shorter.

Figure 3:
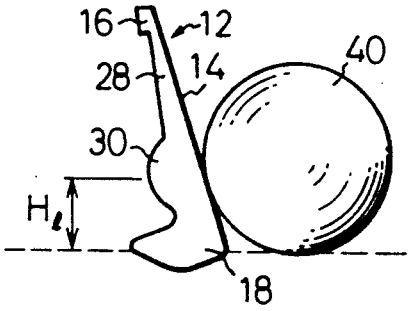
FIG. 3 is a view illustrating a long iron golf club when hitting a golf ball.
Figure 4:
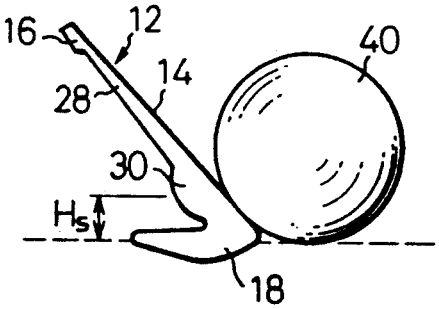
FIG. 4 is a view illustrating a short iron golf club when hitting a golf ball.

As shown in FIG. 3, the loft is small in the case of the long iron golf club, so that the hitting point (height $H_L$) of the golf ball 40 becomes high. The position of the weighted portion 30 is correspondingly high and it is possible for the center of gravity and the sweet spot to conform to or be located near to the hitting point. As shown in FIG. 4, the loft is large in the case of the short iron golf club, and the hitting point (the height $H_S$) of the golf ball 40 becomes low. The position of the weighted portion 30 is correspondingly low and it is possible for the center of gravity and the sweet spot to conform to or be located near to the hitting point. The enclosing rim wall 26 substantially the entire region of the rear surface 16 ensures a widening of the area of the sweet spot.

As explained above, in the iron golf club set according to the present invention, a ratio of a first value of the width of a hitting surface on the side of the toe to a second value of the width of a hitting surface on the side of the heel becomes larger as the length of the shaft in the set becomes longer, so that it is possible for the player to toe hit the golf ball as the length of the shaft in the set becomes longer but still obtain a smooth swing. Also, by displacing the position of the weighted portion of the back design of the head of the iron golf club, it is possible to vary the position of the sweet spot of each iron golf club in correspondence with the loft, and displace the position of the center of the gravity higher and nearer to the toe, so that it is possible for the center of gravity to conform to the hitting point within the wide sweet spot area to thereby improve the hitting efficiency, and it is possible for the player to toe-hit the golf balls as the length of the shaft in the set becomes longer but still obtain a smooth swing.

While the invention has been particularly shown and described in reference to preferred embodiments thereof, it will be understood by those skilled in the art that changes in form and details may be made therein without departing from the spirit and scope of the invention.

I claim:

1. An iron golf club set comprising a plurality of iron golf clubs, each of said iron golf clubs including a shaft and a head attached to said shaft, said head having a hitting surface for hitting a golf ball, a rear surface on the back of said hitting surface, a sole between said hitting surface and said rear surface, a toe and a heel, wherein a ratio of a first value of the width of said hitting surface on the side of the toe to a second value of the width of said hitting surface on the side of the heel becomes larger as the length of the shaft in the set becomes longer, wherein the first value of the width of said hitting surface becomes smaller and the second value of the width of said hitting surface becomes smaller as the length of the shaft of said iron golf club in the set becomes longer, wherein a weighted portion is provided on said rear surface of said head of each of said iron golf clubs, said weighted portion being displaced nearer to said sole as the length of the shaft of said iron golf club in the set becomes shorter, and wherein said rear surface of said head includes a rim wall enclosing a recess, said weighted portion having opposing end portions coupled to said rim wall and traversing across said recess.

* * * * *